US005938068A

United States Patent [19]

Atkins et al.

[11] Patent Number: 5,938,068

[45] Date of Patent: Aug. 17, 1999

[54] CONTAINER WITH REMOVABLE COVER

[75] Inventors: Todd Atkins, Dansville; Donald L. Dixon, Jr., Jackson, both of Mich.

[73] Assignee: Dart Container, Mason, Mich.

[21] Appl. No.: 09/067,529

[22] Filed: Apr. 27, 1998

Related U.S. Application Data

[60] Provisional application No. 60/069,240, Dec. 11, 1997.

[51] Int. Cl.[6] ..... B65D 43/14

[52] U.S. Cl. ..... 220/839; 220/837; 220/266; 220/4.23

[58] Field of Search ..... 220/266, 836, 220/837, 839, 4.22, 4.23, 4.24, 4.25; 229/904, 906, 120.011

[56] References Cited

U.S. PATENT DOCUMENTS

| | | | |
|---|---|---|---|
| 2,884,155 | 4/1959 | Hanson | 220/266 X |
| 2,915,214 | 12/1959 | Frankel . | |
| 2,925,191 | 2/1960 | Shiffman . | |
| 3,489,265 | 1/1970 | Puente . | |
| 3,685,645 | 8/1972 | Kawaguchi | 206/602 X |
| 3,937,389 | 2/1976 | Wind . | |
| 4,273,249 | 6/1981 | Florian | 220/4.24 |
| 4,848,649 | 7/1989 | Fuller et al. | 229/120.011 X |
| 5,040,695 | 8/1991 | Adams et al. | 220/270 |
| 5,799,794 | 9/1998 | Whitnell | 229/904 X |

*Primary Examiner*—Stephen K. Cronin
*Attorney, Agent, or Firm*—Rader, Fishman, Grauer & McGarry

[57] ABSTRACT

A container for storing food items comprising a cover hingedly mounted to a tray. The hinge comprising one or more hinge lines. A line of weakness is provided to aid in the removal of the cover from the tray. The line of weakness preferably comprises a series of closed crests and troughs.

21 Claims, 5 Drawing Sheets

Fig. 1
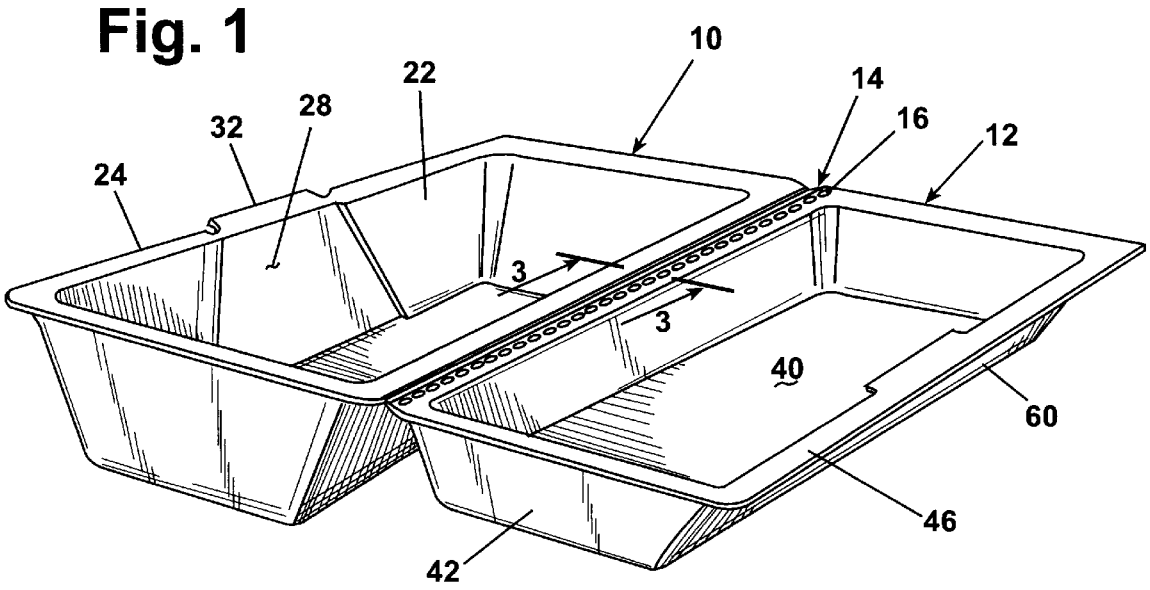
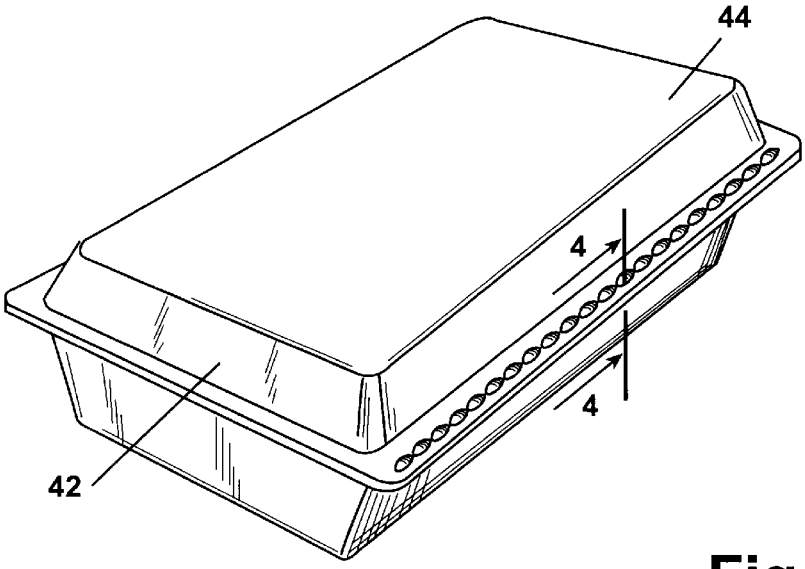
Fig. 2

CONTAINER WITH REMOVABLE COVER

RELATED CASES

This application claims priority on U.S. Provisional Patent Application Ser. No. 60/069,240, filed Dec. 11, 1997.

BACKGROUND OF THE INVENTION

1. Field of the Invention

This invention relates to containers and, more particularly, to disposable food containers having a removable cover.

2. Description of the Related Art

The prior art includes many disposable single-service food containers adapted to permit food to be eaten directly from the container. Furthermore, these containers are often used to reheat leftover food servings in a microwave oven or the like. They generally include a cover portion and a tray portion joined at a common edge by a hinge. Tray and cover are typically foamed plastic; for example, expanded polystyrene. The tray portion of the container is generally deeper than the cover portion to provide adequate volume for retaining food and fluids.

Such a food container is often used to keep food warm prior to consumption or to aid in the reheating of leftover servings. When a person is ready to eat food stored in the container, she simply folds the cover portion back along the hinge at the side where the cover and tray portions meet. When the container has thus been opened and she intends to eat or otherwise dispose of all the contents, the hinged cover portion is no longer necessary and in the way, particularly when space for eating is limited. Moreover, if the food container is being used to serve food to more than one person, the hinged cover portion is generally an encumbrance and an obstruction when the container is being passed.

U.S. Pat. No. 3,937,389, issued Feb. 10, 1976 to Wind discloses a perforated hinge between a cover and a tray portion of a disposable food container. The perforation is provided to make the hinge more flexible, but is not adapted to accommodate removal of the cover from the tray.

U.S. Pat. No. 2,915,214, issued Oct. 5, 1956 to Frankel discloses a line of perforation on each leg of a V-shaped portion connecting a cover and a tray of a disposable food container. A rounded hinge forms the apex of the V-shaped portion. By grasping the V-shaped portion adjacent to the hinge when the container is in a closed position, a user can remove a tab including the hinge by tearing along the aligned lines of perforation, thereby separating the cover and the tray. This arrangement results in added waste, i.e., the tab; and is more difficult to use because the user must tear two lines of perforation, i.e., a line of perforation in each leg of the V-shaped portion.

SUMMARY OF THE INVENTION

These and other disadvantages of the prior art are overcome by the provision of a line of weakness through the hinge, or adjacent and parallel to the hinge, along the common edge where the tray portion and cover portion meet. By including the line of weakness, the cover portion is cleanly and easily removed from the tray portion whereby a person may use the bottom portion for eating or serving others without let or hindrance.

In a preferred embodiment, the container comprises a tray and a cover adapted to close the tray. The tray comprises a bottom wall and a peripheral side wall, which extends upwardly from the bottom wall, terminating in a peripheral edge. The cover comprises a top wall and a peripheral side wall, which extends downwardly from the top wall, terminating in a peripheral edge. A portion of the peripheral edge of the cover is connected to a portion of the peripheral edge of the tray, connecting the cover to the tray. A first hinge is provided on the connected portion of the peripheral edges whereby the cover is movable about the hinge between an open position and a closed position. In the open position, access is provided to the interior of the tray. In the closed position, the peripheral edges of the tray and cover abut to substantially close the container. A plurality of closed crests and troughs are provided on the connected portion of the peripheral edges to form a tear line along which the cover can be torn from the tray by applying opposing forces to the cover.

Preferably, the first hinge is formed by the plurality of close crests and troughs, which alternate between crests and troughs. Alternatively, the first hinge can be spaced from the plurality of crests and troughs.

The container can further comprise a second hinge on the connected portion of the peripheral edges whereby the inherent resiliency of the material forming the connected portion of the peripheral edges is further weakened, reducing the tendency of the cover from being biased away from the tray, and improving the closure between the cover and the tray.

In a second embodiment, the container comprises a tray and a cover adapted to close the tray. The tray comprises a bottom wall and a peripheral side wall, which extends upwardly from the bottom wall. The peripheral side wall has a peripheral edge. The cover comprises a top wall and a peripheral side wall, which extends downwardly from the top wall. The side wall of the cover also has a peripheral edge. A portion of the peripheral edge of the cover is connected to a portion of the peripheral edge of the tray, connecting the cover to the tray. A first hinge is provided on the connected portion of the peripheral edges whereby the cover is movable about the hinge between an open position and a closed position. In the open position, access is provided to the interior of the tray. In the closed position, the peripheral edges of the tray and cover abut to substantially close the container. A line of weakness is provided on the connected portion of the peripheral edges to form a tear line along which the cover can be torn from the tray by applying opposing forces to the cover.

In a third embodiment, the container comprises a tray and a cover adapted to close the tray. The tray comprises a bottom wall and a peripheral side wall, which extends upwardly from the bottom wall. The peripheral side wall has a peripheral edge. The cover comprises a top wall and a peripheral side wall, which extends downwardly from the top wall. The side wall of the cover also has a peripheral edge. A portion of the peripheral edge of the cover is connected to a portion of the peripheral edge of the tray, connecting the cover to the tray. A second hinge is provided on the connected portion of the peripheral edges whereby the cover is movable about the hinge between an open position and a closed position. A second hinge provided on the connected portion of the peripheral edges and spaced from the first hinge whereby the inherent resiliency of the material forming the connected portion is weakened. In the open position, access is provided to the interior of the tray. In the closed position, the peripheral edges of the tray and cover abut to substantially close the container. A plurality of closed crests and troughs are provided on the connected portion of the peripheral edges to form a tear line along which the cover can be torn from the tray by applying opposing forces to the cover.

BRIEF DESCRIPTION OF THE DRAWINGS

The invention will now be described with reference to the drawings, in which:

FIG. 1 is a top perspective view of a first embodiment of the container according to the invention in its opened condition;

FIG. 2 is a top perspective view of the container of FIG. 1 in its closed condition;

DETAILED DESCRIPTION OF THE PREFERRED EMBODIMENT

A first embodiment of the food container shown generally in FIGS. 1 and 2 includes a tray 10 and cover 12, both generally rectangular in plan view, integrally formed with one another, and joined by a hinge 14 adjacent to a line of weakness 16. The hinge 14 is a narrowed portion of the container defining a common edge or border of the tray 10 and cover 12. The line of weakness 16 is parallel to the hinge 14.

Figure 6:
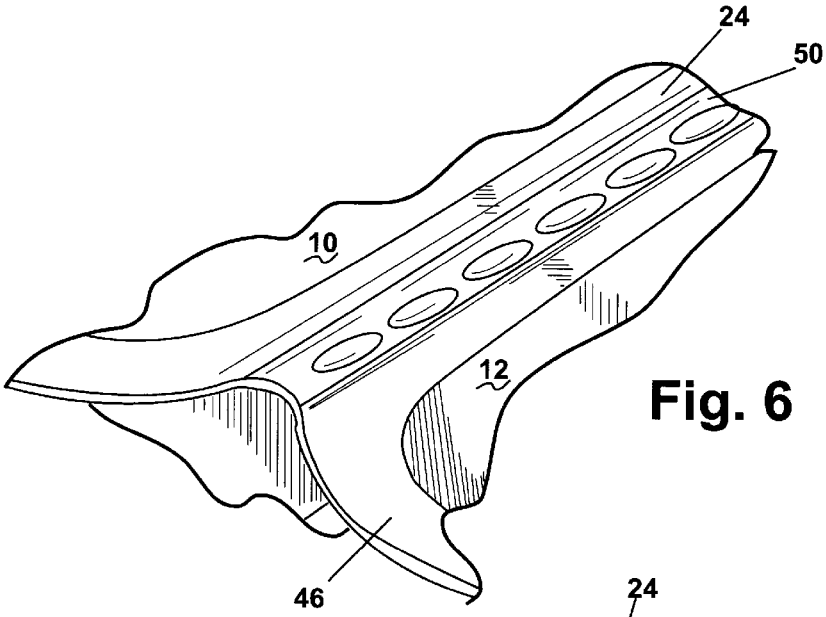
FIG. 6 is a partial top perspective view of a second embodiment of the container according to the invention in its opened and non-separated condition.
Figure 7:
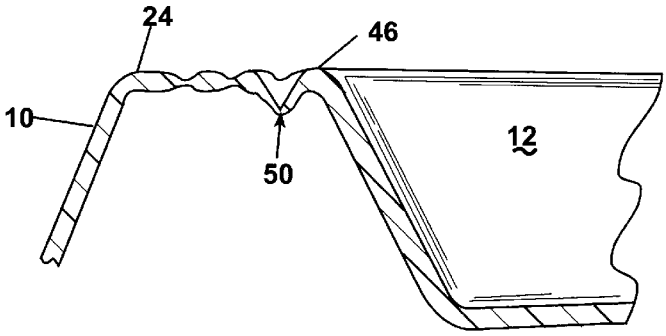
FIG. 7 is a partial side cross-sectional view of an integrated hinge and line of weakness of the container of FIG. 6 in its opened condition.
Figure 8:
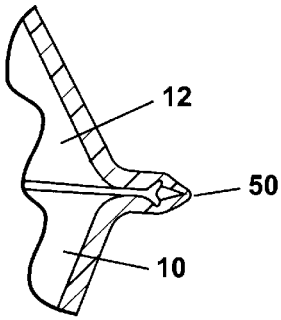
FIG. 8 is a partial side cross-sectional view of the hinge and line of weakness of the container of FIGS. 6 and 7, but in its closed condition.

A second embodiment of the food container shown in FIGS. 6–8 differs from the first embodiment only in that the hinge and line of weakness are integrated; that is, a perforated hinge 50 integrally joins the tray 10 and cover 12 and defines a common edge or border of the tray 10 and cover 12.

Both the tray 10 and the cover 12, including the hinge 14 or 50, are made of a foamed plastic material, typically styrene, and preferably direct injection polystyrene foam.

Figure 3:
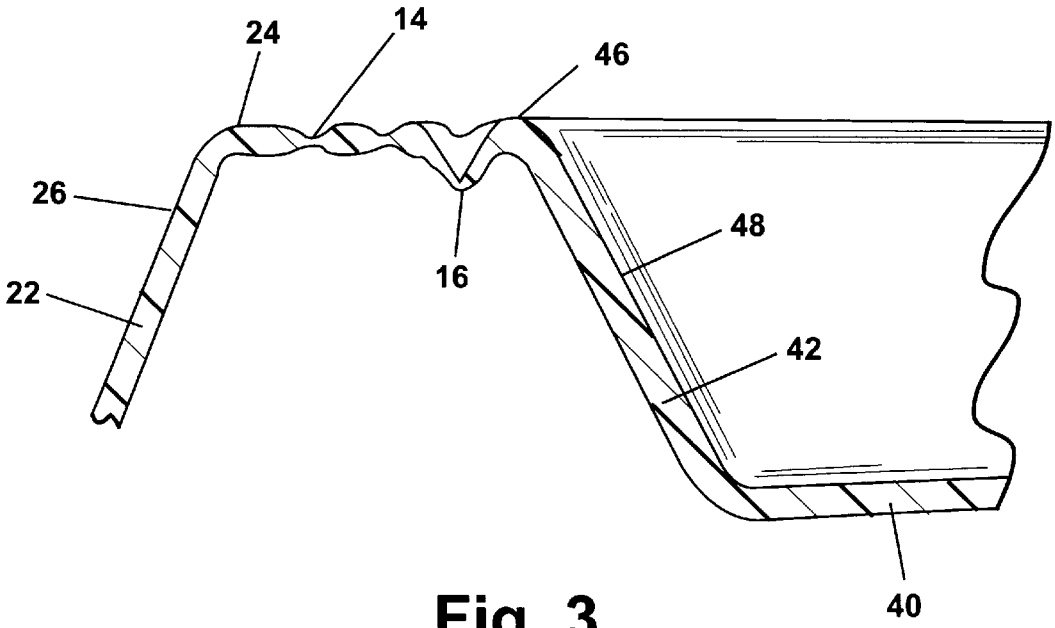
FIG. 3 is a partial side cross-sectional view of a hinge and line of weakness of the container of FIGS. 1 and 2 in its opened condition.
Figure 4:
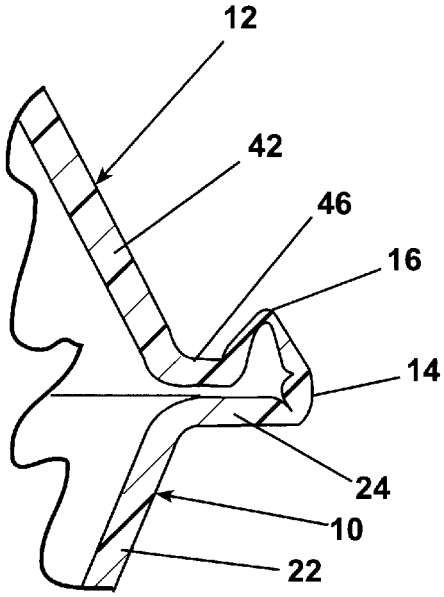
FIG. 4 is a partial side cross-sectional view of the hinge and line of weakness of the container of FIGS. 1 to 3, but in its closed condition.

The tray 10 is provided with a bottom wall 20 and an upwardly and outwardly extending sidewall 22 that defines the depth of the tray 10 about the four sides of the bottom wall 20. Surrounding the upper periphery of sidewall 22 is an outwardly extending and generally horizontal flange 24. The hinge 14 or 50 lies at the outer extremity of the flange 24 at a rear portion 26 of the sidewall 22, as shown best in FIG. 3 or 6, respectively. The flare of the sidewall 22 is sufficiently large to allow identical containers to be stacked compactly when nested without binding or otherwise becoming difficult to separate.

Centrally disposed and extending outwardly from the flange 24 on a front panel 28 of the sidewall 22 is a rectangular tab 32 that forms part of the latching means for the container. The tab 32 is generally horizontally oriented, and extends coplanar with and superior to the flange 24.

The cover 12 includes a top wall 40 and an outwardly and downwardly extending sidewall 42 which generally correspond in size to bottom wall 20 and sidewall 22, respectively, of the tray 10. The sidewall 42 is formed with a flange 46 extending outwardly from a lower edge of the sidewall 42 to be matingly received by the flange 24, to which it generally corresponds in size.

The area of the top wall 40 is slightly greater than that of the bottom wall 20 to accommodate the stacking of identical containers on top of one another in the closed condition. To further stabilize an upper container on such a stack, the top wall 40 is formed with a ridge 44 formed about its periphery where it joins the sidewall 42. The ridge 44 inhibits an upper container placed on top of the cover 12 of a lower stacked container from sliding laterally off the top wall 40.

The flare of the sidewall 42 forms generally the same angle with the vertical as the sidewall 22 of the tray. Similar in pitch to the sidewall 22, the sidewall 42 enables covers 12 of identically-sized containers to nest closely to one another without binding.

The lower edge of the sidewall 42 includes an outwardly extending flange 46 which overlies the flange 24 of the tray 10 when the cover 12 is in the closed position as shown in FIG. 2. The hinge 14 or 50 joins the flanges 24 and 46, and thus the tray 10 and cover 12, the line of weakness 16 being disposed at a rear panel 48 of the sidewall 42. The flange 46 covers the flange 24 of the tray 10 when the cover 12 is closed so as to fully enclose the tray 10 and provide a sanitary and thermal closure for the container.

The sidewall 42 of the cover 12 includes a front panel 60 formed with a slotted aperture (not shown) centrally located therein and adjacent and superior to the outwardly extending flange 46. The tab 32 is receivable in slotted aperture to releasably lock the cover 12 on the tray 10, as is commonly done in the art. The tab 32 is released from the slotted aperture 62 by pressing on an outer face of the front panel 28 of the tray 10 directly below the tab 32 and the outwardly extending flange 46 to force the tab 32 inwardly until the tab 32 clears the slotted aperture 62 and the cover 12 is free to rotate about the hinge 14 or 50.

In the first embodiment shown generally in FIGS. 1 to 5, the line of weakness 16 on the flange 46 adjacent and parallel to the hinge 14 permits the cover 12 to be easily removed from the tray 10. It should be apparent in the second embodiment shown generally in FIGS. 6 to 8, however, that the line of weakness functions as the hinge 50 and permits the cover 12 to be easily removed from the tray 10.

Figure 5:
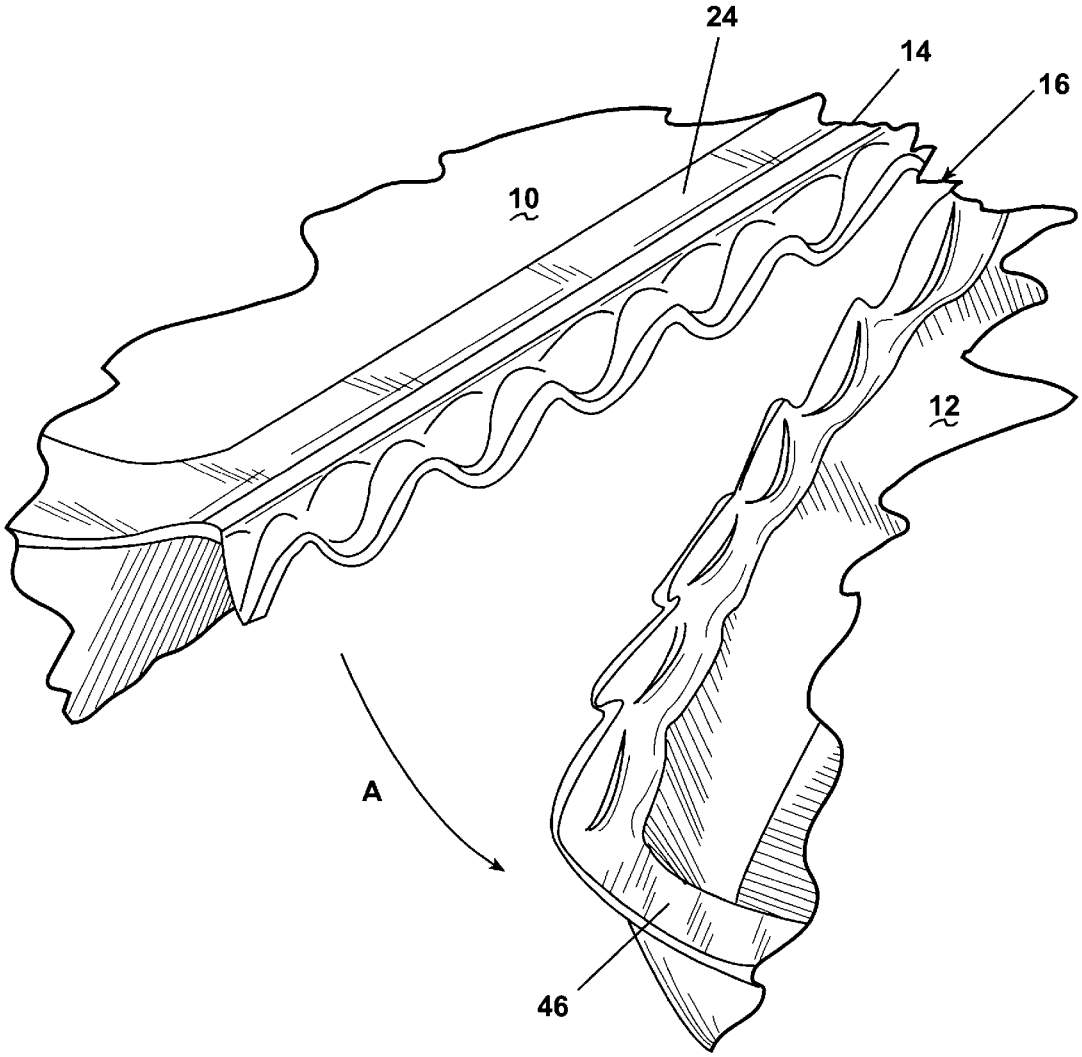
FIG. 5 is a partial top perspective view of the container of FIGS. 1 to 4 in a partially separated condition.

As best illustrated in FIGS. 5 and 7, the lines of weakness 16 or 52 are a series of alternating, rounded crests and troughs of narrowed thickness formed in the flange 46. The lines of weakness 16 or 52 are closed and do not break through the material containing the line of weakness. In other words, the closed crests and troughs do not pass completely through the material forming the container, which is advantageous over previous perforations that passed completely through the lid to form a series of holes.

The previous perforations with holes created a break in the closure between the cover and the tray through which spilled liquid or steam from hot food in the container. The preferred line of weakness according to the invention does not pass through the material, improving the closure of the cover with the tray and preventing liquid or steam from escaping through the line of weakness. For comfort more than safety, rounded edges are preferred to sharp edges, while maintaining an easy means of separation. Post-severance, the lines of weakness 16 or 52 on the tray 10 have a scalloped appearance, as shown in FIG. 5.

For clarity, the term line of weakness as used herein includes deformations in the material that pierce the material, that is create a hole in the material, e.g., perforations, and deformations that do not pierce the material. A line of weakness that does not pierce the material is generally referred to as "closed", such as closed crests and troughs forming the line of weakness of the invention, for example.

A user can readily separate the cover 12 from the tray 10 by tearing along the line of weakness 16 or 50; for example, by drawing the cover 12 in the direction of arrow A in FIG. 5, respectively, whereby the container is separated into two sections. Upon severance along the line of weakness 16 or 50, the tray 10, unencumbered by the hinged cover 12, is more easily used as a dish from which food may be served or eaten. The cover 12 can be disposed of after removal or the tray can be nested in the cover to get the latter out of the way.

Figure 9:
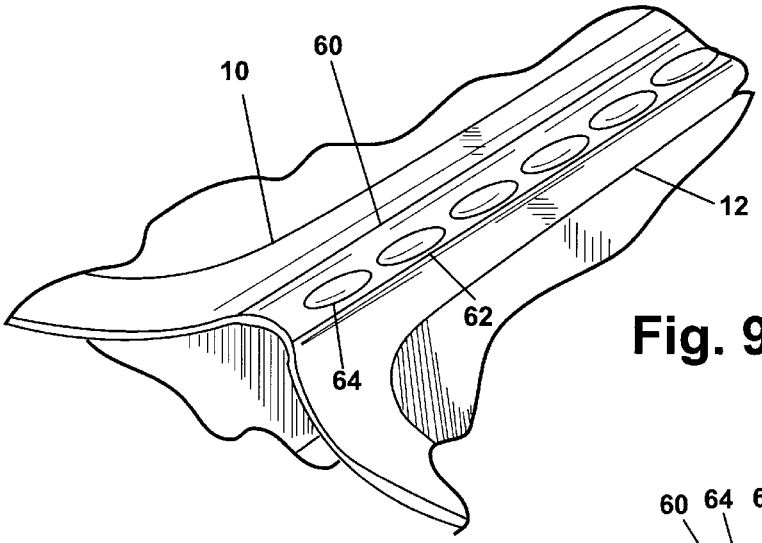
FIG. 9 is a partial top perspective view of a third embodiment of the container according to the invention in its opened and non-separated condition.
Figure 10:
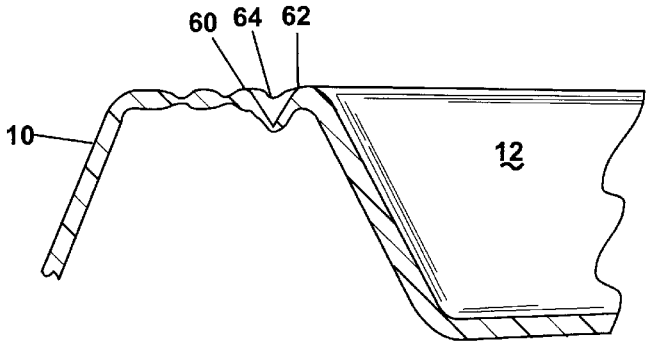
FIG. 10 is a partial side cross-sectional view of an integrated hinge and line of weakness of the container of FIG. 9 in its opened condition.
Figure 11:
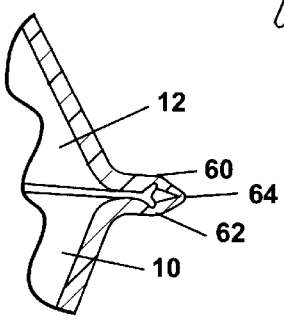
FIG. 11 is a partial side cross-sectional view of the hinge and line of weakness of the container of FIGS. 6 and 7 but in its closed condition.

FIGS. 9 to 11 illustrate a third embodiment of the container according to the invention. The third embodiment is substantially identical to the first and second embodiments except for the hinge portion connecting the tray and cover. Therefore, like numerals will be used to identify like parts of the three embodiments and only the hinge portion is described in detail.

The third embodiment comprises a tray 10 and a cover 12, which are joined by a pair of hinges 60 and 62, between which is disposed a line of weakness 64. The dual hinges 60 and 62 weaken the material connecting the tray 10 and cover 12 more than a single hinge. The dual hinges effectively provide a weaker hinge connection, which advantageously reduces the natural resiliency or spring force of the container material, resulting in the cover 12 making a better closure with the tray 10 than would be achieved with a single hinge.

In previous designs there was a tendency for the cover to bow or pop up, breaking contact between a portion of the cover and tray flanges. The cover tended to bow because the tab side of the cover was compressivly locked to the tray and the folded material containing the hinge had sufficient resiliency than an upwardly bending moment was applied to the cover between the hinge and the tab, lifting a portion of the cover flange out of contact with tray flange.

Preferably, the closure between the cover 12 and the tray 10 is further improved by the line of weakness 16 being closed and not extending through the material. That is, the line of weakness 64 is formed in such a manner that it does not pierce the material to create holes in the material through which liquid or steam within the container could escape. The combination of the dual hinges 60, 62, and the line of weakness 64 results in a container whose cover 12 forms a closure with respect to the tray 10 that is superior than previous containers. The improved closure is advantageous in that foods placed within the container tend to stay warmer longer and lose less of their moisture. Additionally, liquids within the container are less likely to spill during normal handling.

The container according to the invention has several advantageous over prior containers. Of most importance, the container according to the invention has improved cover-separating characteristics. Additionally, the container also has improved closing characteristics. These improved characteristics are attributable to the hinge configuration and the line of weakness.

While particular embodiments of the invention have been shown, it will be understood, of course, that the invention is not limited thereto since modifications may be made by those skilled in the art, particularly in light of the foregoing teachings. Thus, reasonable variation and modification are possible within the scope of the foregoing disclosure of the invention without departing from the spirit of the invention.

We claim:

1. A container comprising:

a tray having a bottom wall and a peripheral side wall extending upwardly from the bottom wall and having a peripheral edge;

a cover having a top wall and a peripheral side wall extending downwardly from the top wall and having a peripheral edge, a portion of the peripheral edge of the cover being connected to a portion of the peripheral edge of the tray to connect the cover to the tray;

a first hinge provided on the connected portion of the peripheral edges whereby the cover is movable about the hinge between an open position, wherein access is provided to the tray, and a closed position, wherein the peripheral edges of the tray and the cover abut to substantially close the container; and a plurality of closed crests and troughs on the connected portion of the peripheral edges to form a tear line along which the cover can be torn from the tray by applying opposing forces to the cover.

2. A container according to claim 1 wherein the first hinge is formed by the plurality of closed crests and troughs.

3. A container according to claim 1 wherein the plurality of crests and troughs alternate between crests and troughs.

4. A container according to claim 1 wherein the first hinge is spaced from the plurality of crests and troughs.

5. A container according to claim 1, and further comprising a second hinge on the connected portion of the peripheral edges whereby the inherent resiliency of the material forming the connected portion of the peripheral edges is further weakened, reducing the tendency of the cover from being biased away from the tray, and improving the closure between the cover and the tray.

6. A container according to claim 5 wherein the plurality of crests and troughs are disposed between the first and second hinges.

7. A container according to claim 5 wherein the first and second hinges each are an area of reduced thickness in the connected portion.

8. A container according to claim 7 wherein the container is molded and the reduced thickness areas are formed during the molding process.

9. A container according to claim 1 wherein each of the peripheral edges further comprise a peripheral flange and the peripheral flanges abut when the cover is in the closed position to form the closure between the cover and the tray.

10. A container comprising:

a tray having a bottom wall and a peripheral side wall extending upwardly from the bottom wall and a peripheral edge;

a cover having a top wall and a peripheral side wall, extending downwardly from the top wall, a peripheral edge provided on the side wall, and a portion of the peripheral edge of the cover being connected to a portion of the peripheral edge of the tray to connect the cover to the tray;

a first hinge provided on the connected portion of the peripheral edges whereby the cover is movable about the hinge between an open position, wherein access is provided to the tray, and a closed position, wherein the peripheral edges of the tray and the cover abut to substantially close the container; and a line of weakness on the connected portion of the peripheral edges and spaced from the first hinge to form a tear line along which the cover of the peripheral can be torn from the tray by applying opposing forces to the cover.

11. A container according to claim 10 wherein the line of weakness is formed by a plurality of closed crests and troughs.

12. A container according to claim 11 wherein the plurality of crests and troughs alternate between crests and troughs.

13. A container according to claim 10, and further comprising a second hinge provided on the connected portion of the peripheral edges whereby the inherent resiliency of the material forming the connected portion of the peripheral edges is further weakened, reducing the tendency of the cover from being biased away from the tray, and improving the closure between the cover and the tray.

14. A container according to claim 13 wherein the line of weakness is disposed between the first and second hinges.

15. A container according to claim 13 wherein the first and second hinges each are an area of reduced thickness in the connected portion.

16. A container according to claim 15 wherein the container is molded and the reduced thickness areas are formed during the molding process.

17. A container comprising:

a tray having a bottom wall and a peripheral side wall extending upwardly from the bottom wall and having a peripheral edge;

a cover having a top wall and a peripheral side wall extending downwardly from the top wall and having a peripheral edge, a portion of the peripheral edge of the cover being connected to a portion of the peripheral edge of the tray to connect the cover to the tray;

a first hinge provided on the connected portion of the peripheral edges whereby the cover is movable about the hinge between an open position, wherein access is provided to the tray, and a closed position, wherein the peripheral edges of the tray and the cover abut to substantially close the container;

a second hinge provided on the connected portion of the peripheral edges and spaced from the first hinge whereby the inherent resiliency of the material forming the connected portion of the peripheral edges is weakened by the first and second hinges, reducing the tendency of the cover from being biased away from the tray, and improving the closure between the cover and the tray; and a line of weakness on the connected portion of the peripheral edges and spaced from the first hinge to form a tear line along which the cover can be torn from the tray by applying opposing forces to the cover.

18. A container according to claim 17 wherein one of the first and second hinges is formed by the line of weakness.

19. A container according to claim 17 wherein the line of weakness comprise a plurality of closed and alternating crests and troughs.

20. A container according to claim 17 wherein the container is molded and the first and second hinges each are an area of reduced thickness in the connected portion formed during the molding process.

21. A container according to claim 17 wherein each of the peripheral edges further comprise a peripheral flange and the peripheral flanges abut when the cover is in the closed position to form the closure between the cover and the tray.

* * * * *